United States Patent [19]

Abermeth et al.

[11] 4,440,126

[45] Apr. 3, 1984

[54] BRAKING DEVICE FOR A VALVE CONTROLLED INTERNAL COMBUSTION ENGINE

[75] Inventors: Hubert Abermeth; Andreas Deckert, both of Cologne; Helmut Müller, Bensberg; Jurgen Wahnschaffe, Bergisch Gladbach, all of Fed. Rep. of Germany

[73] Assignee: Klöckner-Humboldt-Deutz Aktiengesellschaft, Cologne, Fed. Rep. of Germany

[21] Appl. No.: 458,141

[22] Filed: Jan. 14, 1983

Related U.S. Application Data

[62] Division of Ser. No. 229,124, Jan. 28, 1981, Pat. No. 4,378,765.

[30] Foreign Application Priority Data

Feb. 1, 1980 [DE] Fed. Rep. of Germany ..... 3003566

[51] Int. Cl.[3] ..... F02D 13/04

[52] U.S. Cl. ..... 123/321; 123/90.18

[58] Field of Search ..... 123/321–323, 123/90.16, 90.17, 90.18

[56] References Cited

U.S. PATENT DOCUMENTS

| | | | |
|---|---|---|---|
| 862,448 | 8/1907 | Cornilleau | 123/90.17 |
| 2,178,152 | 10/1939 | Walker | 123/321 |
| 3,144,009 | 8/1964 | Goodfellow et al. | 123/90.17 |
| 3,523,465 | 8/1970 | Harrell | 123/90.18 |
| 3,945,221 | 3/1976 | Miokovic | 123/90.17 |

*Primary Examiner*—William A. Cuchlinski, Jr.

*Attorney, Agent, or Firm*—Becker & Becker, Inc.

[57] ABSTRACT

A braking device for a valve controlled internal combustion engine for motor vehicles. Each cylinder has at least one exhaust valve, which is controllable for opening thereof by a camshaft having a main cam for moving operation and a supplementary cam which additionally becomes effective during braking operation. The supplementary cam is arranged in the plane of the main cam, and is capable of being lowered in the camshaft. The cam peak of the supplemental cam is arranged from 160° to 200° ahead of the main cam peak in the direction of rotation of the camshaft. The sides of the supplementary cam are embodied in such a way that upon reaching the upper dead center point, the exhaust valve associated therewith closes. The supplementary cam is capable of being actuated by a control shaft arranged in the rotational axis of the camshaft.

5 Claims, 8 Drawing Figures

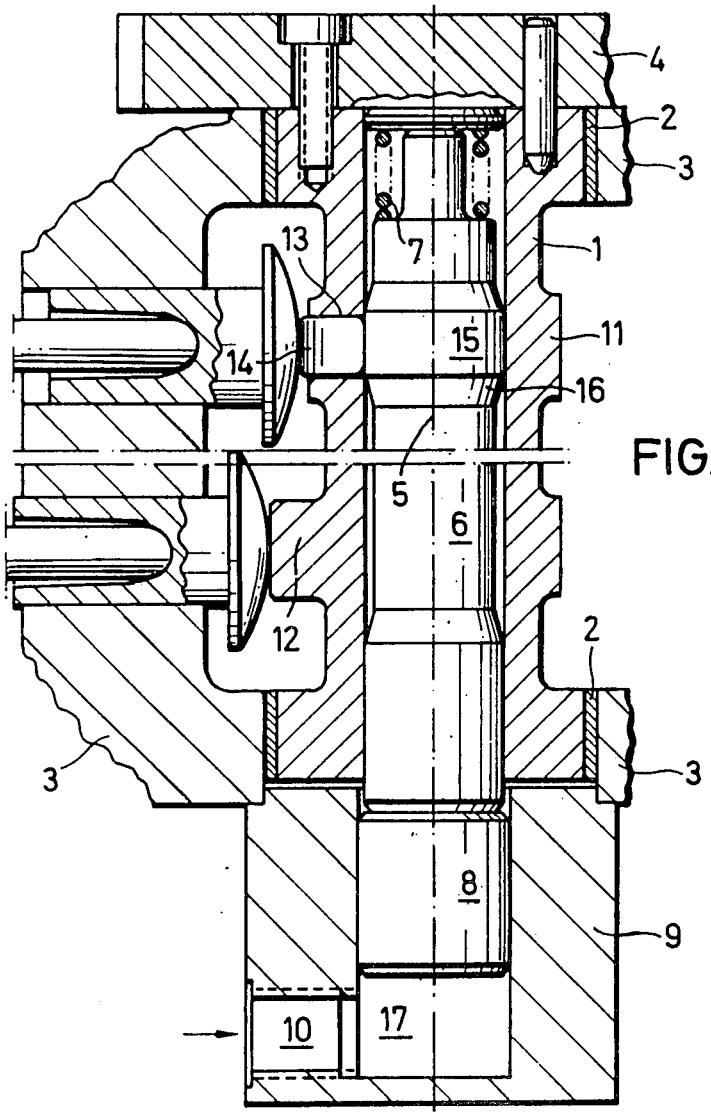
FIG. 1
FIG. 2
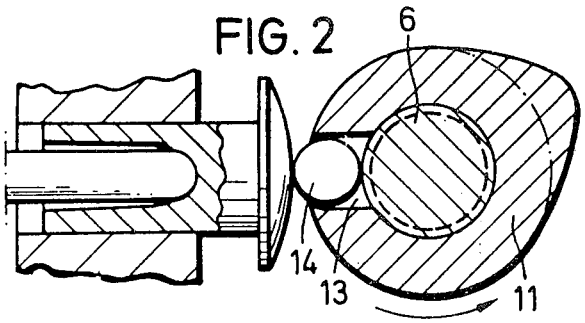
FIG. 3
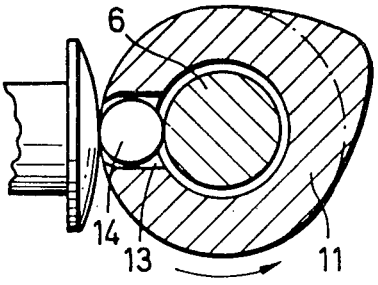

BRAKING DEVICE FOR A VALVE CONTROLLED INTERNAL COMBUSTION ENGINE

This is a Divisional Application of co-pending parent Ser. No. 229,124-Abermeth et al filed Jan. 28, 1981 now U.S. Pat. No. 4,378,765-Abermeth et al dated Apr. 5, 1983.

The present invention relates to a braking device for a valve controlled internal combustion engine for motor vehicles, according to which each cylinder has at least one discharge or exhaust valve, which is controllable for opening thereof by a camshaft having a main cam for moving operation, and having a supplementary cam which additionally becomes effective during braking operation.

Motor vehicles with rated or permissible collective weight of more than nine metric tons must, in addition to the prescribed operating brake and parking brake, also have a third braking device, a so-called motor brake, which is embodied as a continuous or permanent brake.

Such a motor brake device is disclosed by German Offenlegungsschrift No. 15 26 485, wherein an apparatus is described according to which the camshaft for each exhaust valve has two cams which are arranged sequentially or one after another. The second cam cooperates with a hydraulic push rod, by means of which the corresponding exhaust valve can additionally be actuated in the braking operation. The second cam under these circumstances is so arranged upon the camshaft that it opens the starting-air valve at or near the end of the compression stroke, so that compressed air is released from the cylinder, and energy can consequently discharge which otherwise would move the piston downwardly during the subsequent expansion stroke of the piston. Accordingly, there is attained that also in the phase of the expansion stroke the internal combustion engine must be driven, since the downwardly moved piston is not moved by the compressed air, but rather by the moving vehicle through the intervention of the crankshaft.

The disadvantage of the apparatus described in German Offenlegungsschrift No. 15 26 485 however consists in that for every exhaust valve on the camshaft, a second cam having an axial spacing is provided, so that the camshaft is built considerably longer than normal. Since the elongated camshaft must be installed or accommodated in the cylinder head or in the motor housing, the entire motor must be built longer. However, this is not very feasible with the present day restricted space conditions because of the requirement for high power density with the smallest possible space.

It is therefore an object of the present invention to propose an apparatus, for a motor braking device for reciprocating piston internal combustion engines of the initially mentioned type, not having these disadvantages.

This object, and other objects and advantages of the present invention, will appear more clearly from the following specification in connection with the accompanying drawings, in which:

FIG. 1 is a longitudinal section through a camshaft with a control shaft in accordance with one preferred embodiment of the present invention;

FIG. 2 is a cross section through an exhaust valve cam with an inventive supplementary cam in the braking operation position;

FIG. 3 is a cross section through an exhaust valve can with the inventive supplementary cam in the moving operation position;

Figure 4A:
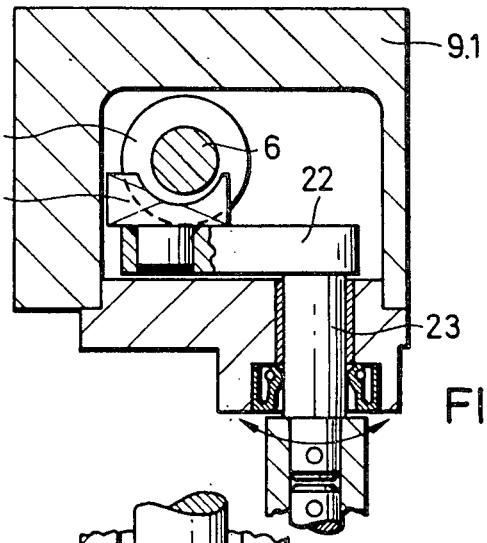
Figure 4B:
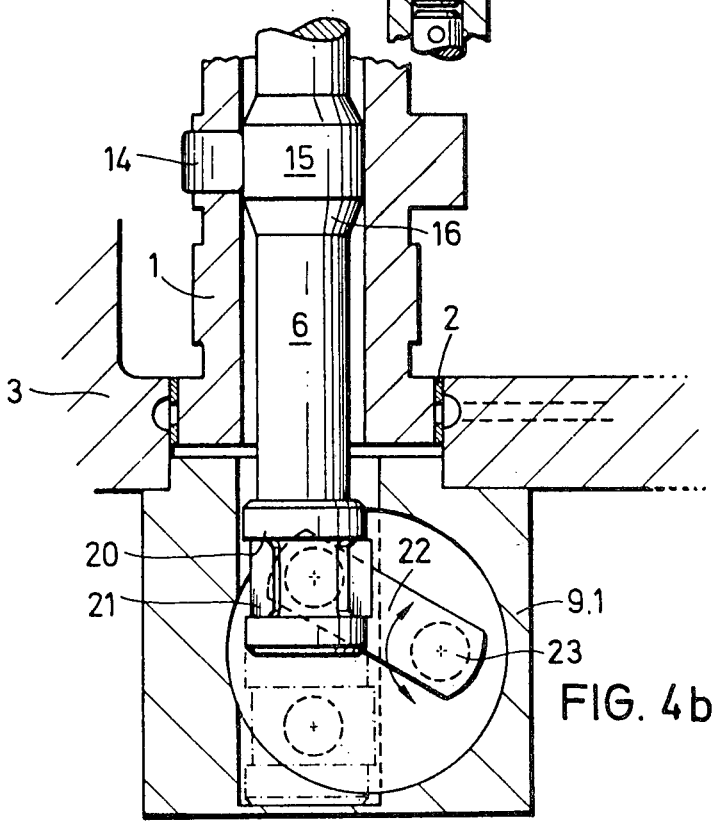
Figure 5:
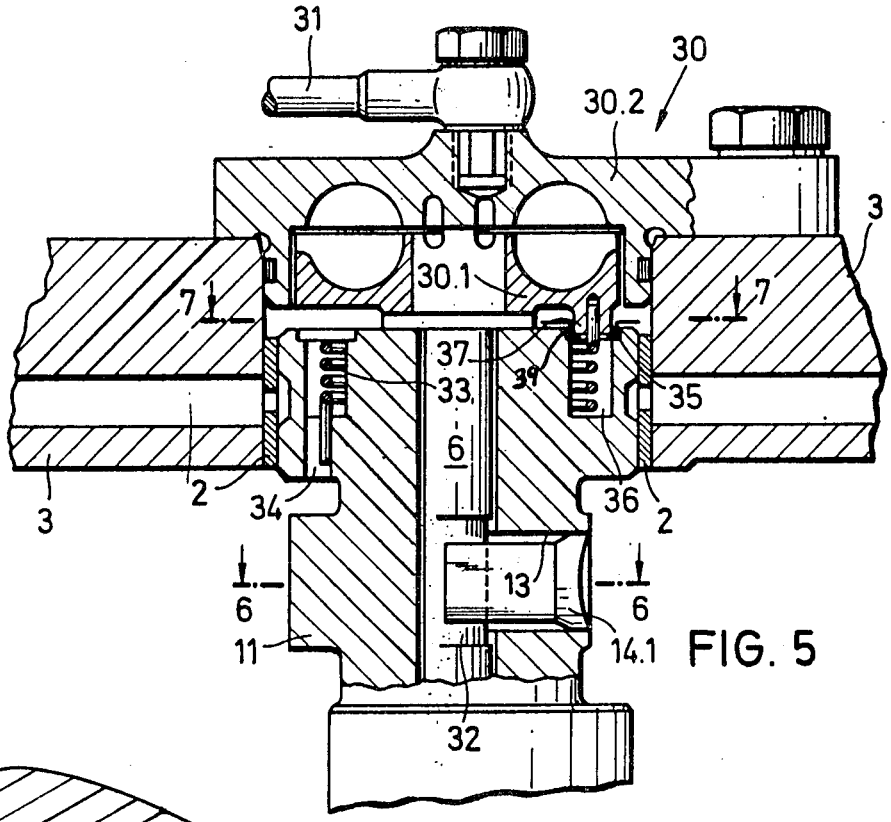
Figure 6:
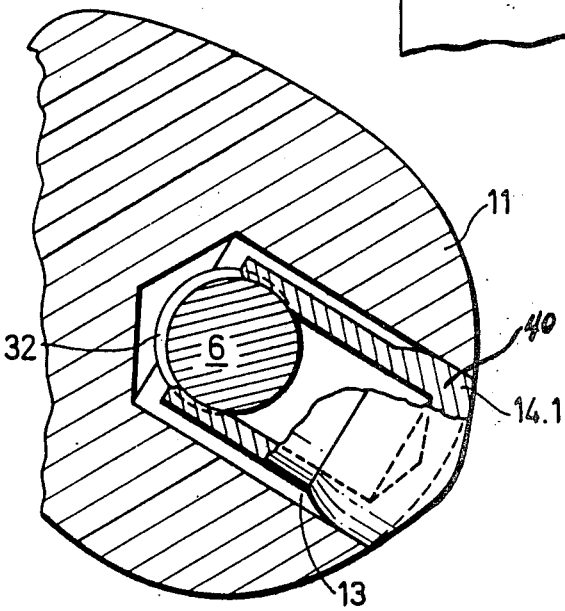
Figure 7:
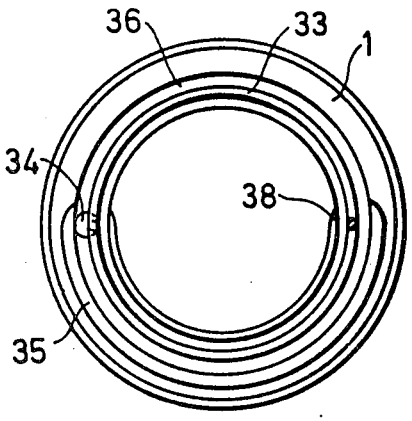

FIG. 4*a* and 4*b* show an alternative embodiment for control of the control shaft;

FIG. 5 is a longitudinal section through a camshaft with its end bearing or support, and an alternative embodiment of the control shaft;

FIG. 6 is a cross section through an exhaust valve can of the camshaft of FIG. 5; and FIG.7 is an end view of the camshaft of FIG. 5.

The braking device of the present invention is characterized primarily in that the supplementary cam is arranged in the plane of the main cam, and is capable of being lowered in the camshaft. Consequently, it is possible to integrate in the main cam the supplementary cam, which is needed only in braking operations, so that the camshaft, in spite of the supplementary cam, has the same structural length as it does without the supplementary cam. A further advantage is recognizable therein that the supplementary cam operates the same rocker arm or valve rocker as the main cam without intermediate connection of further transfer elements.

Tests have shown that it is advantageous to arrange the cam peak of the supplementary cam from 160° to 200° ahead of the main cam peak in the rotational direction of the camshaft. This means that the exhaust valve is opened approximately 80° before the upper dead center point, in the braking operation, so that the piston can push the already compressed air through the exhaust valve into the exhaust gas system, as a result of which an additional braking effect of the motor or engine is generated by there impinging or striking the closed air brake.

If the supplementary cam is embodied in such a way that it closes the associated exhaust valve upon reaching the upper dead center point, the advantage is thereby obtained that a pre-supplying of the cylinder with counterpressure from the exhaust gas system is avoided, and even that, by means of the subsequent expanision, the residual air remaining in the cylinder in the upper dead center point generates an underpressure which likewise represents a further additional braking effect. Because of these opening and closing conditions, the greatest possible braking power is achieved without damage occurring to the internal combustion engine as a consequence of difficulties during the lubrication in the cylinder.

A further development of the present invention proposes actuation of the supplemental cam, which can only be permitted to participate in the valve operation during the braking operation of the internal combustion engine, by means of a control shaft arranged in the rotational axis of the camshaft. This embodiment has the advantage that no additional space requirement needs to be provided on every supplementary cam itself for a separate control device for actuating the supplementary cam. Because of the control shaft in the camshaft, it is possible to permit simultaneous extension or retraction of all of the supplementary cams of the internal combustion engine.

In this connection, it is advantageous to extend or drive out the additional cam thereby that the control shaft is axially displaceable in the camshaft, and has a section with tapered or conical sides in the region of the supplementary cam. A pressure spring may be arranged on one end face of the control shaft, being effective counter to the shifting direction of the control shaft.

The actuation of the control shaft is made especially simple when the camshaft needs to be actuated only in one direction, and is returned to the starting position in the other direction by the force of the spring. For this purpose, it is expedient that the control shaft be actuated by a control device only in the braking operation, and that the spring hold the control shaft in its unactuated position.

The shifting or displacement of the control shaft can occur electrically, pneumatically, hydraulically, or manually by way of a linkage, or in connection with turning-on or engaging of the braking operation control. For the purpose of now not having to introduce a space consuming actuating device in the cylinder head in the case of an overhead camshaft, which would result in still having to change the structural length, it is further proposed to shift the control shaft against the spring force in the operating position by rotating an angle lever which is connected with the control shaft by a pin or sliding piece located between two abutments on the control shaft. This simply constructed gearing requires little space and can be operated by actuating devices arranged externally on the cylinder head in the case of an overhead camshaft. In this connection, special value is placed thereon that also large forces, which are necessary to hold the supplementary cam in its extended position, can be transmitted.

A cylindrical roller is suitable as a supplementary cam, and can be fitted into an opening in the camshaft and, by tapering the opening diameter toward the outer periphery of the main cam, can be prevented from completely exiting the camshaft. This type of supplementary cam, in connection with a shiftably journalled control shaft, makes possible a simple embodiment or configuration, which provides the necessary surface pressing for actuation of the exhaust valve. The retraction of the supplementary cam under these circumstances is especially simple since the supplementary cam is pressed back into its bore by the closing pressure of the valve when the control shaft is in the rest position.

A further embodiment of the present invention provides that, in place of the angle lever for shifting the control shaft, the free end of the control shaft is embodied as a piston which is actuated by pressure oil against the force of the rest spring. This embodiment, although representing a nominal extension or lengthening of the structural length since a cylinder chamber must be provided at the control shaft end, has however, the advantage that in this manner also a lubrication of the movably journalled control shaft and, if desired, lubrication of the supplementary cam, can occur, since the pressure oil required for shifting the control shaft can be readily taken from the oil sump of the internal combustion engine. This brings about the further advantage that in this pressure conduit only one controllable valve must be arranged which is suitably actuated during braking operation.

A further embodiment of the present invention provides arrangement of the control shaft rotatably in the camshaft, and provision of an eccentric in the region of the supplementary cam. In this connection, the supplementary cam is actuated by a rotation of the eccentric relative to the camshaft. Here, too, the rotation occurs expediently against the force of a spring which is arranged between the camshaft and the control shaft and holds the control shaft in the rest position.

According to a further embodiment of the present invention, the control shaft can be especially rotated with nominal space and operating requirement, in such a manner that the supplementary cam participates or takes part in the valve drive, if one end face of the control shaft projects from the camshaft and on this end face there is provided a hydraulically operating coupling, which is actuated in the braking operation and rotates the control shaft counter to the direction of rotation of the camshaft.

A supplementary cam, especially one advantageously cooperating with a rotatably arranged control shaft, may be further characterized thereby that it is essentially cylindrical and is rotatably secured on the control shaft or on an eccentric thereof. To guide this supplementary cam in the main cam, it is advantageous if the supplementary cam has a cup-shaped expansion in the direction of shift. In this connection, it is easily possible to optimize the guide surface, without great finishing cost from a technical standpoint, for guiding the supplementary cam in the opening in the camshaft. This type of supplementary cam permits a clear correlation of its position relative to the position of the control shaft, and hence to the operating condition of the hydraulic coupling which rotates the control shaft.

Referring now to the drawings in detail, FIG. 1 is a longitudinal section through a hollow-bore camshaft 1 which is journalled in slide bearings 2 in the housing 3 or cylinder head of an internal combustion engine (not shown in any greater detail). The camshaft 1 is driven by a gear 4 which is secured to one of the end faces thereof. It is to be understood, however, that any other manner of driving the camshaft 1 is also possible.

A control shaft 6 is journalled in the axis of center of rotation 5 of the camshaft 1, but does not rotate positively therewith. The control shaft 6 is arranged so as to be displaceable axially in the camshaft 1 against the force of a spring 7. The spring 7 is supported on one hand against the drive gear 4, and on the other hand against an end face of the control shaft 6. The spring 7 has as its object to hold the control shaft 6 in its starting position or its rest position. This positioning of the spring corresponds to the "moving operation" position. The other end face of the control shaft 6 is embodied as a piston 8 which is guided in a housing 9 which is effective as a cylinder. A bore 10 to the pressure chamber 17is provided in the housing 9, and a pressure medium conduit can be connected to the bore 10.

The camshaft 1 illustrated in FIG. 1 is furthermore provided with two cams 11, 12, with the cam 11 controlling an exhaust valve (not illustrated here) and the cam 12 controlling a likewise not illustrated intake valve of the internal combustion engine. Only parts of the plungers or push rods of the valve control mechanism are illustrated. Approximately 160° in the rotational direction of the camshaft, before the cam peak or tip of the cam 11, the cam is provided with an opening 13 in which a cylindrical roller, which operates as a supplementary cam 14, is arranged in such a manner as to be capable of being lowered (FIGS. 1, 3). The supplementary cam 14 is extended or driven out by the control shaft 6. For this purpose, the control shaft 6, in the region of the cam 11, has a circular collar 15 which projects from the control shaft by way of conical transitions 16.

The control shaft 6 is illustrated in the braking operation position in FIG. 1. For this reason, the circular collar 15 is located below the supplementary cam 14, so that the latter is moved out of the base circle of the cam and can actuate the exhaust valve. To shift the control haft 6 into this position, it is necessary that pressure medium, advantageously motor oil, be supplied by way of the supply or feed bore 10. The pressure medium, which is supplied under pressure, is effective in the pressure chamber 17 upon the piston 8, so that the control shaft 6 is shifted axially against the force of the spring 7.

If a shifting back from braking operation to moving operation is to occur, the pressure medium supply to the supply bore 10 is interrupted and the pressure chamber 17 is relieved of pressure. Consequently, the spring 7 can shift the control shaft 6. The piston 8 empties the pressure chamber 17. The axial shifting of the control shaft 6 by the spring 7 brings about that now only the smaller diameter segments of the control shaft are located below the supplementary cam 14 (FIG. 3). The first rotation of the camshaft subsequent to the shifting back of the control shaft brings about that the plunger or push rod of the exhaust valve presses back the still extended or pushed-out supplementary cam 14 into the opening 13 as a result of the closing force of the exhaust valve. Accordingly, the exhaust valve can only be actuated by the cam 11.

FIG. 2 illustrates the position of the supplementary cam 14 in the braking operation. As apparent therefrom, the supplementary cam 14, upon actuation of the exhaust valve, is clamped between the push rod thereof and the collar 15 of the control shaft 6.

A narrower diameter segment of the control shaft 6 is located below the supplementary cam 14 in the moving operation (FIG. 3), so that the push rod of the exhaust valve can push the supplementary cam 14 completely into its opening 13. The difference of the radii of the control shaft 6 and its collar 15 corresponds to the stroke or lift movement of the supplementary cam 14.

FIGS. 4*a* and 4*b* illustrate an alternative embodiment of the actuation of the control shaft 6. Rather than having a piston 8, the free end of the control shaft 6 has a recess 20. A slotted or sliding piece 21 engages into this recess and is pivotable by means of a gearing formed by a lever 22 and a shaft 23. The pivot movement of the shaft 23 brings about that the sliding piece 21 axially shifts the control shaft 6. This shifting arrangement is likewise installed in a separate housing 9.1, which is flanged or screwed onto the housing 3 of the internal combustion engine. The pivot movement of the shaft 23 can be carried out manually, hydraulically, or electrically. If the spring 7 is provided at the other end of the control shaft 6, then the pivot movement needs to be carried out only in one direction, namely in a direction counter to the pressure effect of the spring 7. In FIG. 4*b*, the control shaft is illustrated by solid lines in the "braking operation" position; the "moving operation" position is represented by dot-dash lines.

FIGS. 5, 6 and 7 illustrate an alternative of the supplementary cam and the actuation of the control shaft 6. The control shaft 6 in this embodiment rotates with the camshaft 1 and is further rotatable relative thereto. The free end face of the control shaft 6 has a hydraulically operating coupling in place of a piston. The coupling 30 comprises a coupling half or section 30.1, which is rigidly connected with the control shaft, and a coupling half or section 30.2, which can be rigidly screwed in the housing 3. The coupling is supplied with oil from the internal combustion engine by way of a supply line 31. A gap is provided between the two coupling halves; this gap serves to allow oil passage or flow therethrough, so that when the oil supply is turned off, the coupling automatically empties.

In contrast to the preceding illustrations, the control shaft 6, in FIG. 5 has an eccentric 32 at the level of the supplementary cam 14.1. The supplemental cam is rotatably secured on the eccentric 32 in that its side walls engage over the mid point of the base circle of the eccentric. The supplementary cam 14.1 in FIG. 5 has a cup-shaped outer contour. The cup-shaped rim 40 serves simultaneously as a guide for the supplementary cam in the opening 13. There is likewise attained therewith that the supplementary cam 14.1, during the rotational movement of the control shaft 6, can move back and forth with the control shaft 6 because of its eccentric fastening in the opening 13.

In the position illustrated in FIGS. 5 and 6, the supplementary cam 14.1 is completely lowered in the opening 13, so that it cannot control the exhaust valve. In this position, the control shaft 6 is pressed by the torsion spring 33, through the intervention of a nose 37 located on the coupling half 30.1, against an abutment 35 which is inserted in the camshaft 1. The torsion spring 33 is inserted in an annular recess in the camshaft 1, and is clamped between the camshaft 1 and the coupling half 30.1.

The coupling 30 is not filled in moving operation. Consequently, the torsion spring 33 becomes effective, so that the control shaft is rotated in such a way that the supplementary cam 14.1 remains in the retracted position, as illustrated in FIGS. 5 and 6.

The hydraulically operating coupling 30 is filled in the braking operation by way of the supply conduit 31. The filling generates a frictional engagement between the coupling half 30.1, which rotates with the camshaft, and the stationary half 30.2. Consequently, the control shaft 6 is rotated against the force of the spring 33, and in particular by approximately 180°, until it reaches a further abutment or stop 38 (FIG. 7). The two abutments or stops 35 and 38 are connected with each other by a semicircular annular ring 39 in which the nose 37 is located. During this rotation, the eccentric 32 pushes or shifts the supplementary cam 14.1 outwardly out of the opening 13 for a distance equalling the eccentricity thereof. As a result, the supplementary cam 14.1 comes into effective or operational connection with the exhaust valve, so that the latter is additionally opened.

The additional opening of the discharge valve in the braking operation attained by the invention because of the supplementary cam now brings about that a piston, of the internal combustion engine, controlled in such a way pushes a considerable part of the drawn-in air into the exhaust conduit during its compression stroke. Upon reaching the upper dead center point of the piston, the exhaust valve is closed by the supplementary cam. Accordingly, with subsequent expansion, no work in the form of compressed air stored work or energy can move the piston downwardly any more. In order to be able to carry out the downward stroke or movement, the crank shaft must be driven differently. This occurs during the braking operation by means of the moving vehicle through the intervention of the transmission and the wheels. It is even possible to arrange the supplementary cam in such a manner that during the expansion stroke of the piston in the cylinder, a slight underpressure results. Consequently, the braking effect of the internal combustion engine is considerably increased.

If a shifting occurs again from braking operation to moving operation, the hydraulically operating coupling 30 is no further filled with oil through the supply line 31. The oil can now discharge or flow away from the hydraulically operated coupling 30 through gaps between the two coupling halves 30.1 and 30.2, and can thus pass back into the oil sump of the internal combustion engine by way of suitable passages 34. By emptying the coupling 30, the torsion spring 33 can turn the control shaft 6 back again, so that the supplementary cam 14.1 is again retracted. Consequently, the cam 11 alone again takes over the control of the exhaust valve in a conventional manner.

The present invention is, of course, in no way restricted to the specific disclosure of the specification and drawings, but also encompasses any modifications within the scope of the appended claims.

What is claimed is:

1. A braking device for a valve controlled internal combustion engine for motor vehicles, with each cylinder having at least one exhaust valve, said braking device comprising a camshaft for controlling said at least one exhaust valve for opening thereof, said camshaft having a main cam for moving operation, and a supplementary cam which additionally becomes effective during braking operation, said supplementary cam being arranged in the plane of said main cam and being capable of being selectively lowered in said camshaft, a control shaft arranged in the rotational axis of said camshaft, said control shaft serving for actuation of said supplementary cam, said control shaft being axially displaceable in said camshaft, and including a section with conical sides in the region of said supplementary cam, a pressure spring arranged on one end face of said control shaft, said pressure spring being effective counter to the direction of shift of said control shaft, said control shaft including two abutments, and an angle lever, said angle lever being connected to said control shaft between said two abutments by means of a sliding piece, and said angle lever being rotatable against the force of said pressure spring for displacing said control shaft in the operating position.

2. A braking device for a valve controlled internal combustion engine for motor vehicles, with each cylinder having at least one exhaust valve, said braking device comprising a camshaft for controlling said at least one exhaust valve for opening thereof, said camshaft having a main cam for moving operation, and a supplementary cam which additionally becomes effective during braking operation, said supplementary cam being arranged in the plane of said main cam and being capable of being selectively lowered in said camshaft, a control shaft arranged in the rotational axis of said camshaft, said control shaft serving for actuation of said supplementary cam, said control shaft rotating with said camshaft and being provided with an eccentric in the region of said supplementary cam, said control shaft rotating relative to said camshaft against the force of a spring.

3. A braking device according to claim 2, in which one end face of said control shaft projects from said camshaft and is provided with a hydraulically operating coupling.

4. A braking device for a valve controlled internal combustion engine for motor vehicles, with each cylinder having at least one exhaust valve, said braking device comprising a camshaft for controlling said at least one exhaust valve for opening thereof, said camshaft having a main cam for moving operation, and a supplementary cam which additionally becomes effective during braking operation, said supplementary cam being arranged in the plane of said main cam and being capable of being selectively lowered in said camshaft, a control shaft arranged in the rotational axis of said camshaft, said control shaft serving for actuation of said supplementary cam, said control shaft rotating with said camshaft and being provided with an eccentric in the region of said supplementary cam, said supplementary cam being rotatably secured on said eccentric of said control shaft, said supplementary cam widening outwardly in a cup-shaped manner.

5. A braking device according to claim 4, in which said camshaft is provided with an opening, said supplementary cam is fitted in said opening, and the outer periphery of said cup-shaped widening serves for guiding said supplementary cam in said opening.

* * * * *